US006983939B2

(12) United States Patent
Pulkrabek

(10) Patent No.: US 6,983,939 B2
(45) Date of Patent: Jan. 10, 2006

(54) THREE DIMENSIONAL ARCHERY TARGET WITH REPLACEABLE TARGET ELEMENTS

(75) Inventor: Larry R. Pulkrabek, Cloquet, MN (US)

(73) Assignee: Field Logic, Inc., Superior, WI (US)

( * ) Notice: Subject to any disclaimer, the term of this patent is extended or adjusted under 35 U.S.C. 154(b) by 0 days.

(21) Appl. No.: 10/313,184

(22) Filed: Dec. 6, 2002

(65) Prior Publication Data

US 2004/0108659 A1 Jun. 10, 2004

(51) Int. Cl.
*F41J 3/00* (2006.01)

(52) U.S. Cl. ..... 273/403

(58) Field of Classification Search ..... 273/403, 273/404, 406, 407, 408
See application file for complete search history.

(56) References Cited

U.S. PATENT DOCUMENTS

| | | | | |
|---|---|---|---|---|
| 3,088,738 | A | 5/1963 | Meyer | |
| 4,076,246 | A | 2/1978 | Meyer | |
| 4,126,501 | A | 11/1978 | Croll | |
| 4,203,600 | A * | 5/1980 | Brown | 273/407 |
| 4,244,585 | A | 1/1981 | Croll | |
| 4,374,571 | A | 2/1983 | Hirvela | |
| 4,477,082 | A | 10/1984 | McKenzie et al. | |
| 4,643,434 | A * | 2/1987 | Carlin | 273/408 |
| 4,813,684 | A | 3/1989 | Bruno | |
| 4,940,244 | A | 7/1990 | Batts, III | |
| 5,307,584 | A | 5/1994 | Jarvis | |
| 5,465,977 | A | 11/1995 | Mann | |
| 5,498,001 | A * | 3/1996 | Franks et al. | 273/403 |
| 5,503,403 | A | 4/1996 | Morrell | |
| D369,631 | S | 5/1996 | Stewart et al. | |
| 5,649,708 | A * | 7/1997 | Podlesny | 273/403 |
| 5,865,440 | A | 2/1999 | Pulkrabek | |
| 6,068,261 | A * | 5/2000 | Nettle | 273/408 |
| 6,254,100 | B1 | 7/2001 | Rinehart | |
| 2002/0113372 | A1 | 8/2002 | Love | |
| 2002/0145256 | A1 | 10/2002 | McKenzie et al. | |
| 2003/0177588 | A1 | 9/2003 | Howell | |

OTHER PUBLICATIONS

Printout from website: http://www.fieldlogic.com Block_all_arrows.htm, 2 pages; Block_durability, 2 pages;Block_arrow_removal, 2 pages Block_portable_freestanding_weatherproof, 2 pages; Oct. 31, 2002.

Printout from website: http://www.fieldlogic.com/ Block_letter_to_range_operators.htm, 5 pages; Oct. 31, 2002.

Flyer: *The Block by Northern Whitetail*; 1998; Northern Whitetail; White Bear, Minnesota; 2 pages.

Guide: *Archery Business*; Mar./Apr. 1997; 2 pages.

Brochure: *McKenzie Targets* 1997; McKenzie Targets, Granite Quarry, NC; 7 pages.

* cited by examiner

*Primary Examiner*—Mark S. Graham
(74) *Attorney, Agent, or Firm*—Faegre & Benson LLP

(57) ABSTRACT

A three-dimensional archery target having at least one three-dimensional body segment. The body segment includes an outer surface having at least one target aperture. The target aperture is connected to a chamber within the body segment. One or more planar target elements are located in the chamber and subject to a compressive force on major surfaces thereof. The planar target elements comprise a plurality of side edges forming a target face accessible through the target aperture.

48 Claims, 12 Drawing Sheets

THREE DIMENSIONAL ARCHERY TARGET WITH REPLACEABLE TARGET ELEMENTS

FIELD OF THE INVENTION

The present invention is directed to a three-dimensional archery target with replaceable target elements.

BACKGROUND OF THE INVENTION

Various types of archery targets are known, including conventional three-dimensional life-size animal-simulating archery targets. Such targets have a shape resembling that of a game animal, for example, a deer or other animal. The targets may be formed in a single piece from a lightweight foam material, such as polyurethane foam. These targets are adapted for use with both broad head arrows, which comprise a plurality of intersecting razor blades tapering to a sharp point, and field point or target arrows. Critical target areas may be indicated on the target, e.g., by bull's eye markings, which are either applied onto or molded into the foam target.

Repeated arrow strikes on a foam archery target will cause the target to deteriorate. This outcome is especially true when broad head arrows are used. When a broad head arrow hits a target, the blades forming the arrowhead slice through the target material to a considerable depth. As the target material is hit repeatedly, pieces of the target are cut loose. Therefore, a target is destroyed much more rapidly with broad head arrows than with field point or target head arrows. However, even when field point or target head arrows exclusively are used, at least a portion of the target will inevitably be destroyed with repeated use.

In practice, a very large proportion of the arrow strikes on an archery target fall within a relatively small portion of the target. For example, an archer will typically aim at an area of the target corresponding to vital organs of the animal which the target represents. Most archers will hit this target or bull's eye area most of the time. Therefore, this target area will be destroyed rapidly, due to repeated arrow strikes, while most of the remaining target remains relatively undamaged. The functional life of a three-dimensional life-size animal simulating archery target may be extended, and the cost of using such a target reduced, by making replaceable a target section of the archery target which is likely to be destroyed rapidly due to repeated arrow strikes.

Instead of forming the target from a single piece of molded foam, a three-dimensional life-size animal simulating archery target may be molded in multiple pieces, which are detachably joined together to form the target, such as disclosed in U.S. Pat. No. 4,477,082 (McKenzie, et al.). As one piece of the target is destroyed by repeated arrow strikes, this section alone may be replaced, eliminating the need to replace the entire target. Thus, the life of the target is extended, and the operating cost thereof reduced. The replaceable target section in McKenzie is approximately one-third of the total target. Thus, it is relatively expensive to replace. Further, the vertical dovetails holding the body sections together tend to come apart with repeated arrow strikes, due to the dynamic force of arrows impacting the target.

Another known three-dimensional life-size animal-simulating archery target is described in U.S. Pat. No. 5,503,403 (Morrell). This archery target includes a foam body, which may be formed of front and rear body sections connected together by a dovetail joint structure. The foam body includes a target insert receiving recess into which a target insert is placed. The target insert may be filled with packing material, such as cotton molt, for use with only target arrows, or may be formed of foam, for use with both broad head and target arrows. The target insert may be held in place in the recess using straps and wire. A body cover, which may be made of cloth, or molded in foam, is used to cover the removable and replaceable target insert.

U.S. Pat. No. 6,254,100 (Rinehart) discloses an archery target having a target section aperture formed therein and a replaceable target section adapted to fit in the target section aperture. The replaceable target section is held in place in the target section aperture by one or more support rods extending through support rod apertures formed in the body section and the replaceable target section. The support rods may also extend into other target body sections, to hold the target body sections together to form a structurally stable archery target. A replaceable target insert may be positioned in a target insert aperture formed in the replaceable target section. Arrowheads can be damaged or destroyed if they strike the metal support rods. Broad heads either become trapped in the target insert or will cause tear out with relatively few shots.

BRIEF SUMMARY OF THE INVENTION

The present invention is directed to a three-dimensional archery target having at least one three-dimensional body segment with an outer surface having at least one target aperture. The target aperture is connected to a chamber within the body segment. In one embodiment, one or more planar target elements are located in the chamber and subject to a compressive force on major surfaces thereof. The planar target elements comprise a plurality of side edges forming a target face accessible through the target aperture.

In one embodiment, the chamber comprises first and second generally opposing surfaces adapted to apply the compressive force to the target elements. One or both of the first and second generally opposing surfaces can optionally be non-planar. A cover is optionally releasably attached to the body segment that extends across a portion of the chamber. The cover can pivotally attached to the body segment.

In one embodiment, the compressive force is applied to the target elements by a cover. In another embodiment, a plate is located in the chamber. One or more displacement mechanisms can be provided to displace the plate into compressive engagement with the target elements located in the chamber. In another embodiment, at least one wedge shaped plate is located in the chamber to apply a compressive force on the target elements. The compressive force is typically about at least 5 pounds per square foot.

In another embodiment, the compressive force is applied by one or more bands surrounding a plurality of the target elements. In another embodiment, the one or more planar target elements are a replaceable target assembly. Members located in the body segment can be used to secure the target elements in the chamber. The chamber optionally includes at least one surface adapted to mechanically couple with the target elements.

The side edges of the target elements can be arranged generally horizontally or vertically within the chamber. The target elements are preferably constructed of foam. The target elements typically have a thickness in the range of about 1/16 to about 3/8 inches. Foam target elements typically having a density selected in the range of about 2 pounds to about 10 pounds. The one or more target elements can be a single, continuous structure or a plurality of discrete target elements.

The chamber can have first and second opposing surfaces adapted to frictionally engage with the target elements. In another embodiment, the chamber includes at least one surfaces adapted to mechanically couple with the target elements. The surfaces preferably include a structure adapted to mechanically couple with a generally corresponding structure on the target elements.

The archery target preferably has a pair of target apertures located on opposite sides of the body segment, wherein each of the target apertures is connected to the chamber. The pair of target apertures can be generally parallel and/or aligned with each other. In another embodiment, the archery target includes at least three target apertures each connected to the chamber. The target apertures can optionally be oriented perpendicularly with respect to each other. In one embodiment the target face is generally coplanar with a portion of the outer surface adjacent to the target aperture.

In one embodiment, the body segment comprises a plurality of interconnected body segments. The body segments preferably simulates an animal. Reinforcing members optionally extend through portions of the body segment. In one embodiment, the reinforcing members extend substantially around the chamber. The body segment preferably comprises foam.

The present invention is also directed to a three-dimensional archery target with one or more foam target elements comprising a shape that mechanically couples with a generally corresponding shape in the chamber.

The present invention is also directed to a three-dimensional archery target including a plurality of planar foam target elements having a shape that mechanically couples with a generally corresponding shape in the chamber. The planar target elements comprising a plurality of side edges forming a target face accessible through the target aperture.

The present invention is also directed to a three-dimensional archery target having one or more planar foam target elements subject to a compressive force generated by in the chamber. The planar target elements comprise a plurality of side edges forming a target face accessible through the target aperture.

The present invention is also directed to a target element for a three-dimensional archery target having a target aperture connected to a chamber within a body segment. The replaceable target element includes one or more foam members having a pair of major surfaces, a first pair of generally opposing side edges adapted to be a target face, and a second pair of generally opposing side edges adapted to mechanically couple with corresponding structures in the chamber.

The replaceable target element can be a single structure or a plurality of planar foam members. In one embodiment, the second pair of generally opposing side edges include a notch, a curvilinear shape and/or a taper adapted to engage with a generally corresponding structure in the chamber.

The present invention is also directed to a method of using a three-dimensional archery target having a target aperture connected to a chamber within a body segment. The method includes the steps of positioning one or more planar target elements in the chamber in the three-dimensional body segment and applying a compressive force to major surfaces of the target elements such that side edges of the planar target elements comprise a target face accessible through the target aperture in the body segment.

The method also includes the steps of relieving the pressure from the planar target elements, replacing one or more planar target elements, and applying a compressive force to the planar target elements.

The compressive force can be applied by the chamber, closing a cover over the chamber, displacing a plate located in the chamber or inserting one or more wedge shaped members into the chamber. In another embodiment, the compressive force is applied by one or more bands surrounding the target elements. The target elements can optionally be a replaceable target assembly. The target elements are optionally mechanically coupled with a corresponding structure in the chamber.

The present invention is also directed to a method of using a three-dimensional archery target having a target aperture connected to a chamber within a body segment, comprising the step of mechanically coupling side edges of one or more foam target elements with corresponding structures in the chamber. The one or more target elements can be a plurality of planar target elements. The method can also include the step of applying a compressive force to the target elements.

DETAILED DESCRIPTION OF THE INVENTION

Figure 1:
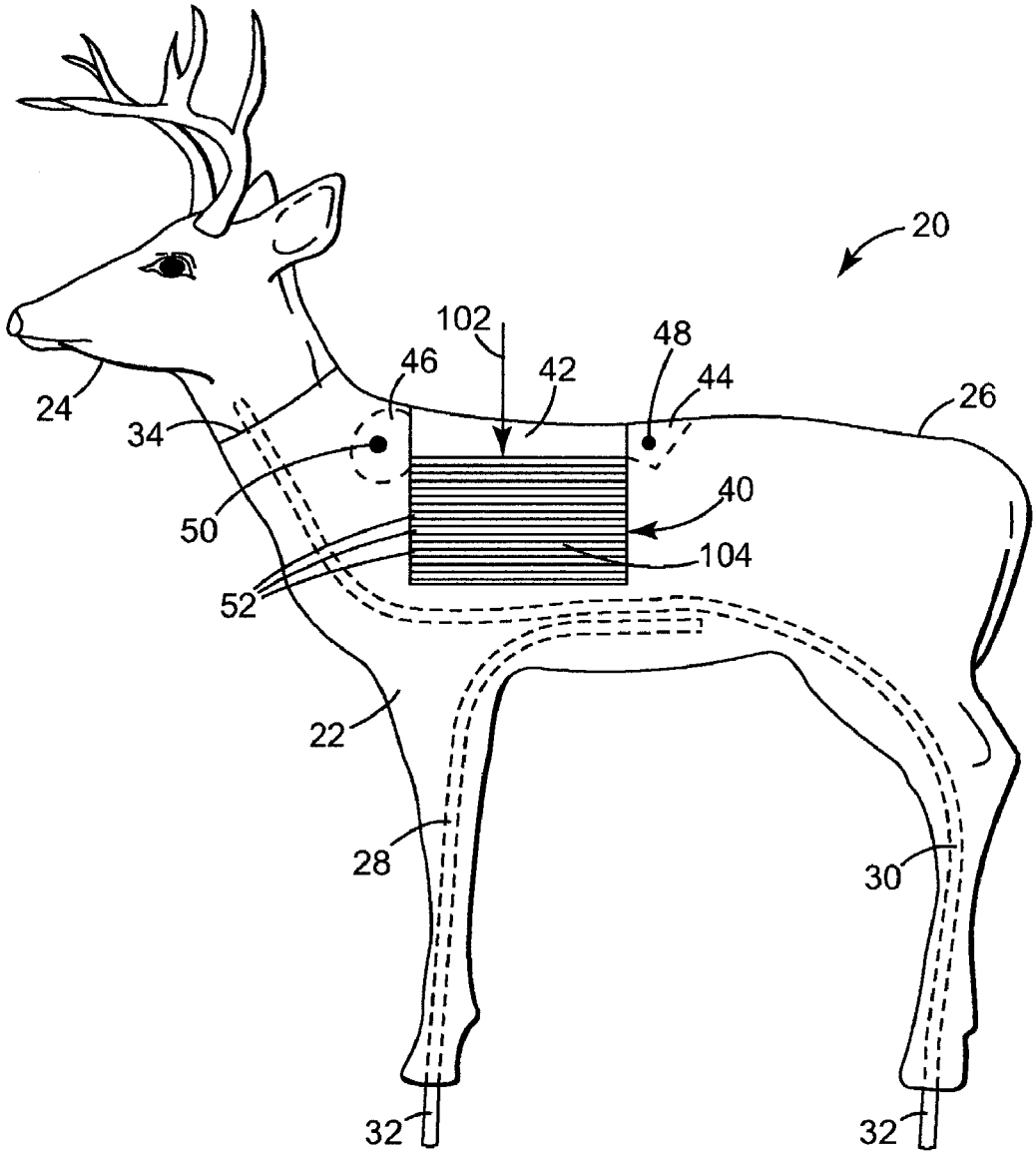
FIG. 1 is a side sectional view of a three-dimensional archery target in accordance with the present invention.

FIGS. 1 through 4 illustrate various aspects of an exemplary three-dimensional archery target 20 in accordance with the present invention. An archery target in accordance with the present invention is preferably formed in the shape and size of a game animal. For example, the three-dimensional archery target 20 of FIGS. 1–4 is formed in the shape and size of a deer.

An archery target in accordance with the present invention can be constructed from one or more body segments, depending on a variety of factors, such as cost, size of the animal being simulated, the posture of the animal, and a variety of other factors. In the embodiment illustrated in FIG. 1, the three-dimensional archery target 20 includes a first body segment 22 and a second body segment 24. The first body segment 22 illustrates the torso and legs of a deer. The second body segment 24 is the head of the deer.

The body segments 22, 24 can be constructed from a variety of natural and synthetic materials, such as wood, paperboard, polymeric materials, such as plastics, foams, non-woven materials, and the like. The body segments 22, 24 can be solid or hollow, depending upon the material from which they are constructed.

Polyurethane foam materials are preferred because of the low cost, ease of molding using conventional molding techniques, lightweight, and durability. Polyurethane foam is a semi-rigid material that can be deformed slightly, but retains that deformed shape instead of returning to its original shape. Polyurethane foam with a density of about 10 pounds to about 50 pounds is preferred. When a broad head arrow tip impacts polyurethane foam, the blades of the points enter the foam causing a x-shaped cut. The foam cuts cleanly rather than being deformed and does not close around so the arrow is generally easy to withdraw. Outer surface 26 of the body segments 22, 24 is preferably coated with a material to seal the foam against moisture, to protect it from UV degradation, and give the target a lifelike appearance.

A variety of reinforcing members 28, 30 are preferably molded into the body segments 22, 24. The reinforcing members 28, 30 can be a variety of materials, such as metal, plastic or composite materials. Metal tubing provides a high degree of rigidity, but can damage an arrow tip that strikes it. Plastic tubing is typically less rigid, but is not as likely to damage the arrow tip.

In one embodiment, the reinforcing members 28, 30 extend beyond the bottom of the body segment 22 to provide anchors 32. The anchors 32 can be driven into the ground or attached to a base in order to support the archery target 20. In an alternate embodiment, metal stakes or other supporting structures are inserted into the optionally hollow reinforcing members 28, 30 to support the archery target 20.

In the illustrated embodiment, the reinforcing member 30 extends all the way into a portion of the second body segment 24 so as to increase the strength at the junction 34. The material and configuration of the reinforcing members 28, 30 can vary with the size and shape of the present three-dimensional archery target and a variety of other factors.

Figure 2:
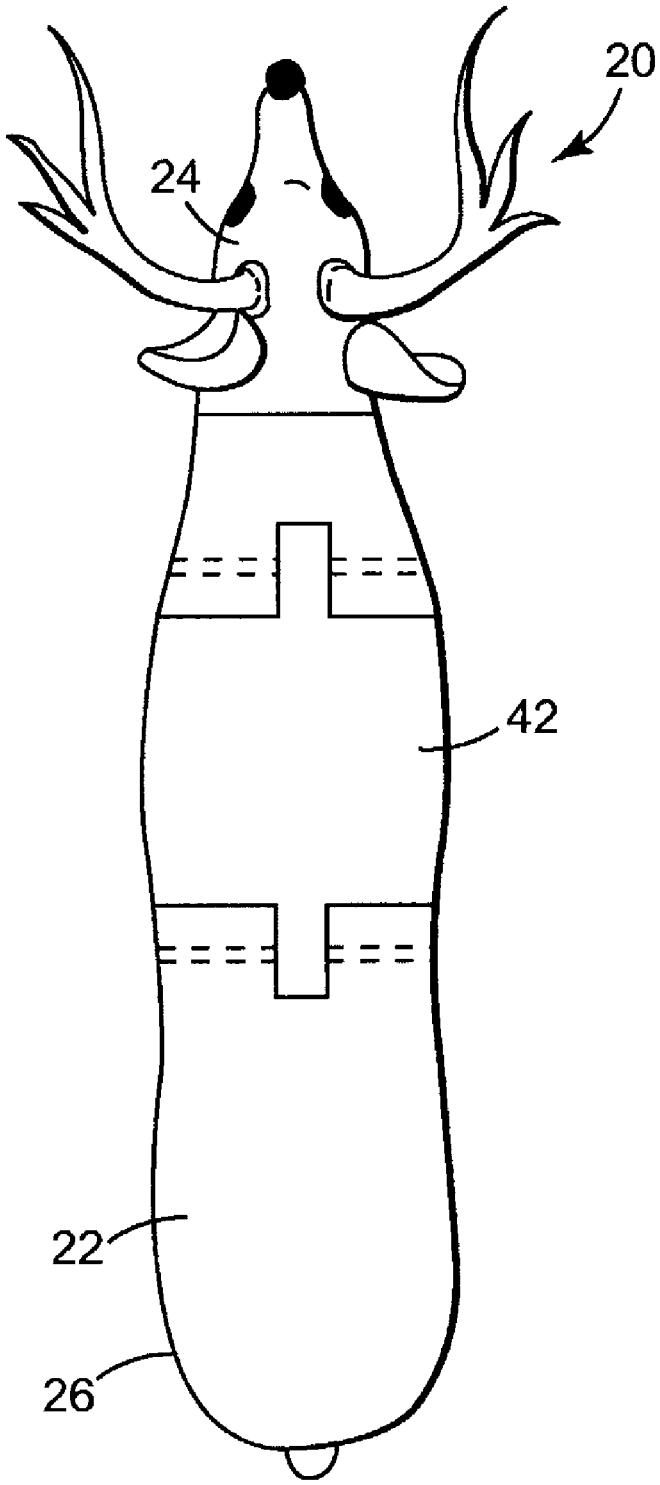
FIG. 2 is a top view of the three-dimensional archery target of FIG. 1.

As best-illustrated in FIGS. 1 and 2, the three-dimensional target 20 includes a replaceable target assembly 40 located in the region of the vital organs of the animal simulated. In the illustrated embodiment, the replaceable target assembly 40 includes a plurality of generally planar target elements 52 arranged so that side edges comprise a target face 104. In another embodiment, the replaceable target assembly 40 includes a single target element, such as a block of foam, that extends substantially across apertures 94, 96 of the archery target 20. As used herein, a "replaceable target assembly" refers to one or more target elements pre-configured to function as an archery target with or without the present three-dimensional archery target.

Figure 3:
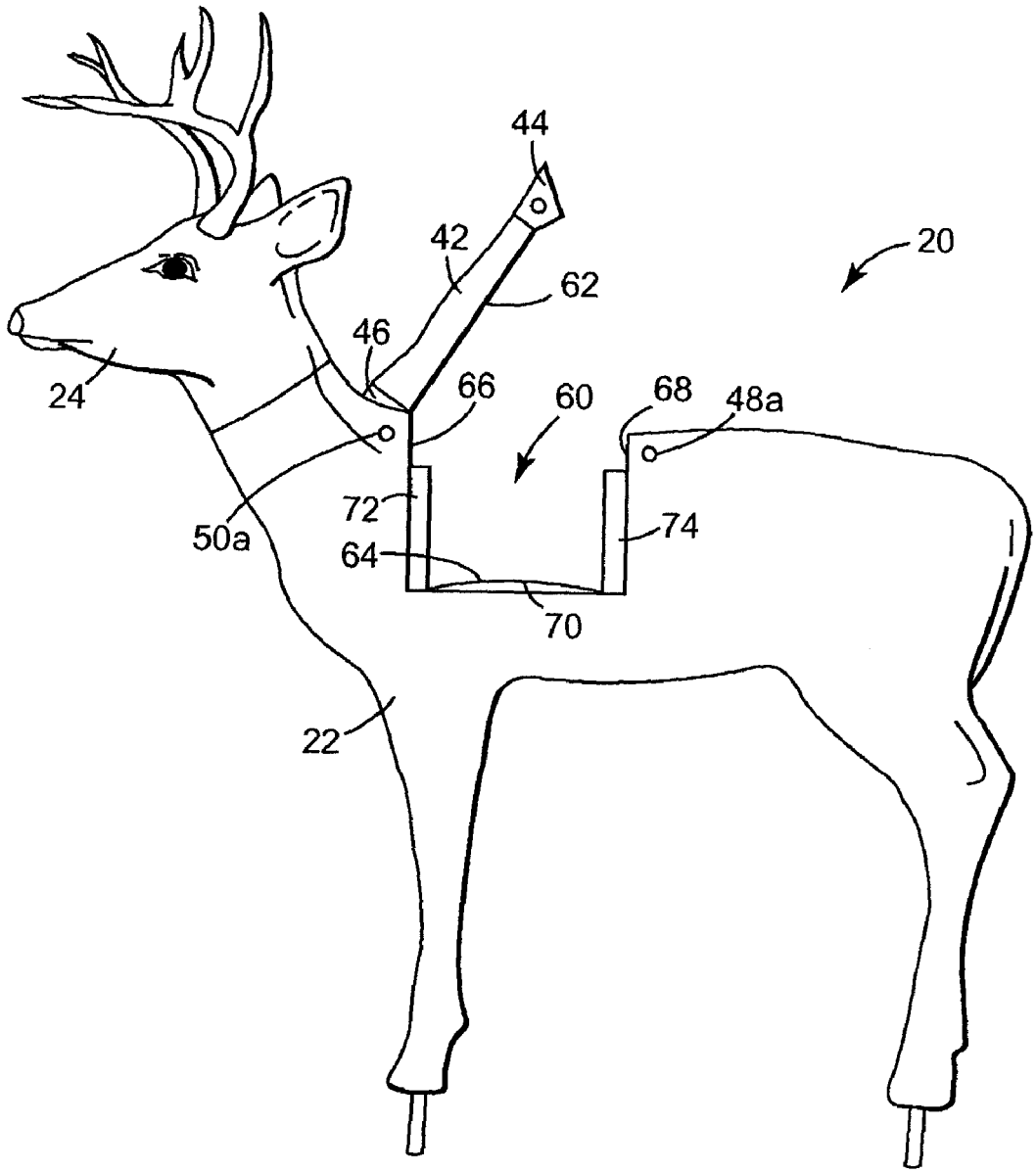
FIG. 3 illustrates a method of installing target elements in the three-dimensional archery target of FIG. 1.
Figure 4:
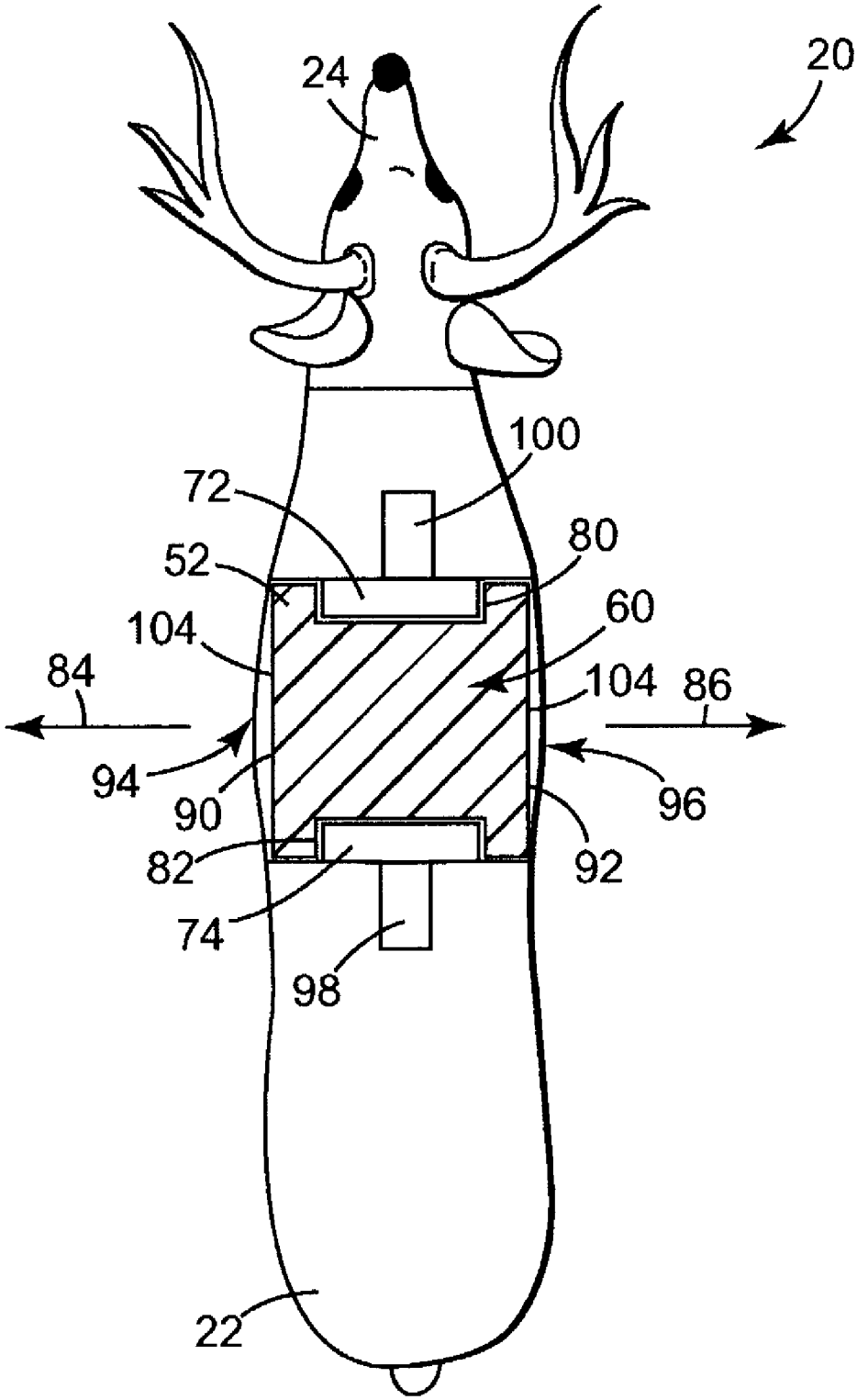
FIG. 4 is a top view of the three-dimensional archery target of FIG. 1 with the cover removed.

As best-illustrated in FIGS. 3 and 4, the replaceable target assembly 40 is located in a chamber 60 formed in the first body segment 22. The chamber 60 preferably extends through the entire width of the first body segment 22 so that the replaceable target assembly 40 is accessible from either side of the archery target 20.

In the illustrated embodiment, the chamber 60 is bounded on four sides. Lower surface 62 of cover 42 forms a top surface of the chamber 60. Lower surface 64 and side surfaces 66, 68 form the other three surfaces of the chamber 60. In the illustrated embodiment, the cover 42 applies a compressive force 102 to the major surfaces of the target elements 52. The compressive force 102 is opposed by the lower surface 64. The lower surface 64 can optionally include a camber or non-planar structure 70 which serves to increase or concentrate the compressive force 102 in the center of the target face 104.

FIG. 4 is a top view of the archery target 20 with the cover 42 removed. In the illustrated embodiment, the target elements 52 have a pair of recesses 80, 82, which mechanically couple with structures 72, 74 on the side surfaces 66, 68 of the chamber. The combination of the recesses 80, 82 and the structures 72, 74 resist movement of the target elements 52 in the directions 84, 86. This arrangement is desirable because the force of an arrow striking the archery target 20 or an arrow being removed from the archery target 20 will fall generally along the directions 84, 86.

As used herein, "mechanically coupled" refers to interengaging structures on target elements and an archery target that resist displacement of target elements relative to an archery target due to an arrow strikes or an arrow being removed. Mechanical coupling does not require a tight mechanical fit between the interengaging structures. A gap may exist between some of the surfaces of the interengaging structures, such as illustrated in FIGS. 4 and 5*a*–5*f*. The gap facilitates installation and removal of the target elements from the chamber. FIG. 4 illustrates an embodiment where the target element 52 has a shape complementary to the structures 72, 74 (see also FIGS. 5*a*–5*f*). As will be illustrated in FIGS. 5*a*–5*f*, the target elements 52 of the present invention can assume a wide variety of shapes, with or without features that mechanically couple with the chamber 60 in the body segment 22.

Figure 6:
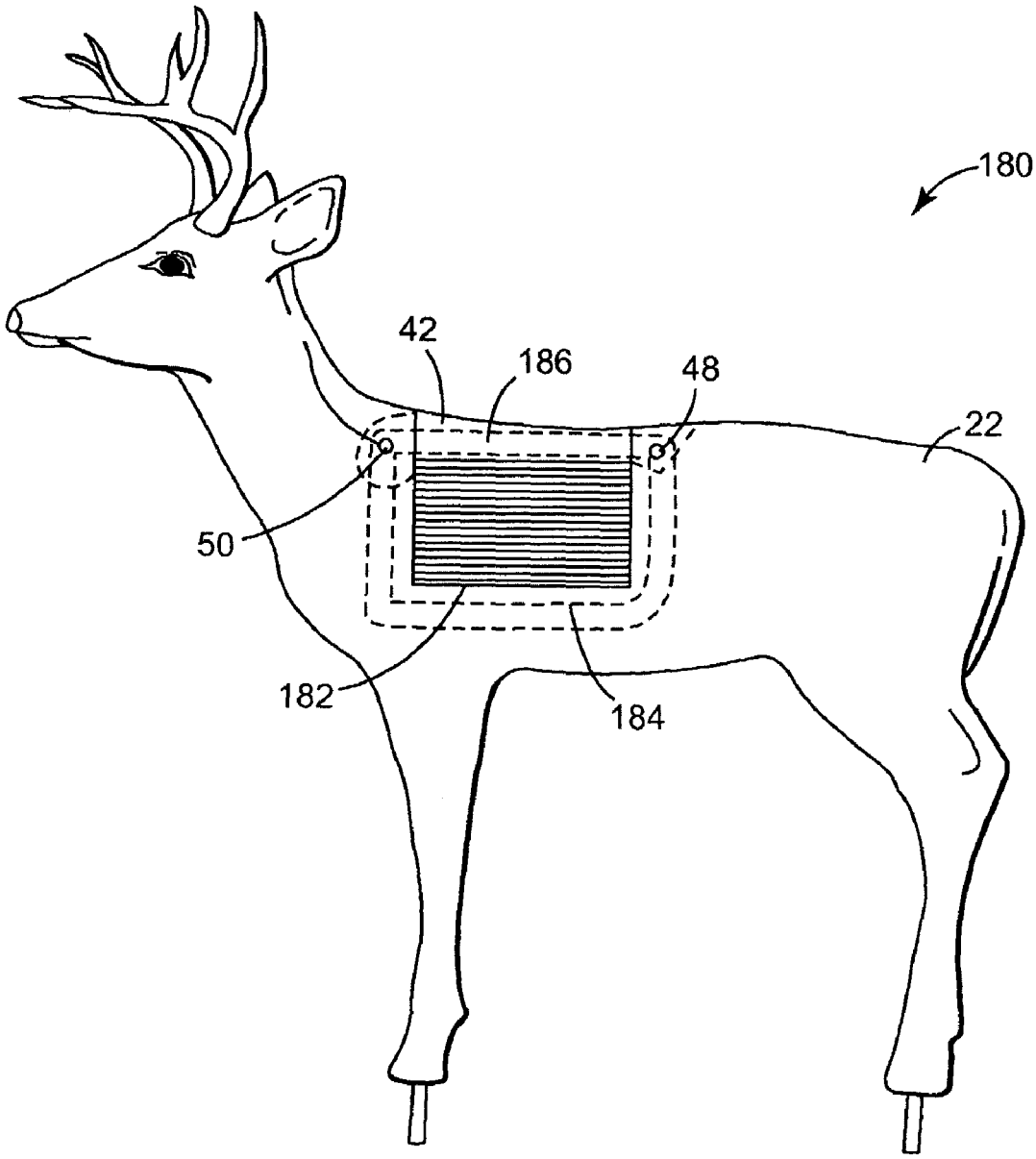
FIG. 6 illustrates a reinforcing structure for a replaceable target assembly in accordance with the present invention.

The method of the present invention includes positioning a plurality of the target elements 52 in the chamber 60. Side edges 90, 92 of the target elements 52 are accessible through first target aperture 94 and second target aperture 96, respectively. The cover 42 is then replaced so that cover anchor 44 is located in recess 98 and cover anchor 46 is located in recess 100. Pins 48, 50 are replaced in holes 48*a*, 50*a*, respectively, so that the cover 42 is securely attached to the first body segment 22. In one embodiment, a reinforcing member is molded into the cover 42 (see FIG. 6). The reinforcing member preferably extends under the pins 48, 50. In the embodiment of FIG. 6, the pins 48, 50 pass through the reinforcing member.

In the illustrated embodiment, the cover 42 applies a compressive force 102 to the target elements 52. The compressive force 102 can be increased or decreased by increasing or decreasing the number of target element 52 located in the chamber 60. The compressive force 102, either alone or in combination with the mechanical coupling of the structures 72, 74 with recesses 80, 82 releasably retain the target elements 52 in the first body segment 22. The side edges 90, 92 of the target elements 52 form the target face 104 located generally where the vital organs of the animal simulated by the archery target 20 are located.

The replaceable target assembly 40 can be repaired by removing the compressive force 102 and replacing some or all of the target elements 52. In many situations, the replaceable target assembly 40 can be restored to essentially perfect condition by replacing less than all of the target elements 52.

The ability to replace individual target elements 52 significantly reduces the cost of maintaining the archery target 20 in working condition.

The target elements 52 are preferably constructed from a foam material, such as disclosed in U.S. Pat. No. 5,865,440 (Pulkrabek), which is incorporated by reference. The foam is weather resistant and can be used either indoors or outdoors. In one embodiment, the foam is compressed to about 70% to about 20% of its uncompressed thickness. In another embodiment, the foam is compressed to about 50% to about 5% of their uncompressed thickness. For high density foam that is not easily compressed, a compressive force of about 5-pounds/square foot or greater is typically used. Other materials, such as corrugated cardboard, softwoods in either solid form or layered structures such as plywood, and materials made from natural or synthetic fibers can also be used for the target elements 52. In another embodiment, the target elements 52 are constructed from a woven or a non-woven polymeric material.

As used herein, "target element" refers to a material adapted to be located in a chamber of an archery target. The target element can be a sheet material with an edge that forms a portion of a target face. Each layer in the replaceable target assembly can be discrete target elements or a larger piece of sheet material folded in a serpentine manner to arrange multiple edges into a target face. The larger piece of sheet material can optionally be die cut to facilitate folding. In another embodiment, the plurality of planar target elements discussed above can be replaced by a single continuous structure or material that extends across a portion of the target aperture in the three-dimensional archery target 20. For example, the target element 52 can optionally be a single piece of foam that extends substantially across the apertures 94, 96. Although the embodiments illustrated in the Figures show the edges of the target elements co-planar, it is possible for the replaceable target assembly to have a non-planar target face.

In one embodiment, the target elements 52 are about ⅛ inch to about ¼-inch thick cross-linked foam. Cross-linked foam exhibits greater self-healing at each puncture hole and provides longer target life, especially when the target is used with arrows having broad head or expandable tips. The combination of relatively thin target elements 52 and the type of foam produce very little compression about the arrow shaft and head. The foam also prevents the arrow from turning during removal, which assures that broad heads follow the same hole on ingress and egress, without tearing. Arrows are therefore easily withdrawn without resort to arrow gripping devices or excessive arm, shoulder or tugging body movement.

The foam may be open or closed cell, although a closed cell polyethylene foam is preferred. Close celled foam is less susceptible to the intrusion of moisture and deterioration from ultraviolet rays. A variety of foam materials, such as polyethylene or polyurethane foams or blends thereof may also be used to advantage. The foam preferably has a density of about 2 pounds to about 10 pounds. In contrast to higher density foam materials, it is believed the low density material facilitates arrow removal without the friction or adherence of the layered material to the arrow that is exhibited by higher density and continuous pour foam targets. The weight of the archery target 20 is also reduced when using a low density foam and which is advantageous for the archer who wants to transport a target to his or her hunting camp.

Figure 5A:
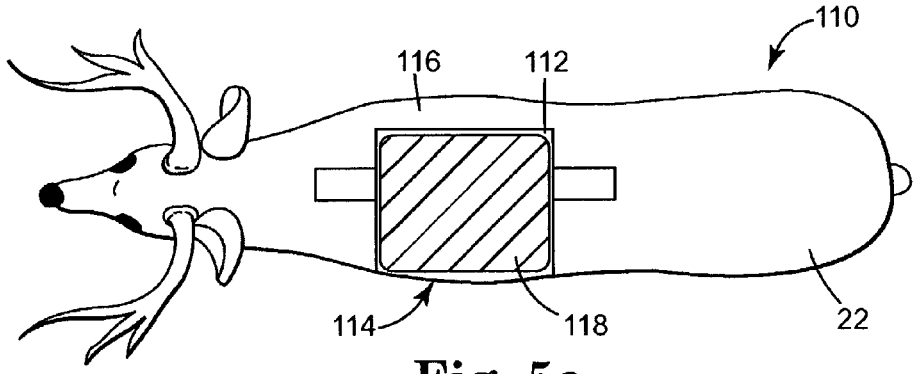
FIGS. 5*a* through 5*f* illustrate various chambers for retaining target elements in a three-dimensional archery target in accordance with the present invention.

FIG. 5*a* is a top view of a three-dimensional archery target 110 having a chamber 112 with a single target aperture 114. FIG. 5*a* illustrates a major surface of target element 118. Portion 116 of the first body segment 22 forms a backstop that serves to retain target elements 118 in the chamber 112 and to prevent arrows from penetrating completely through the body portion 22. The target element 118 can be one of a plurality of planar members or a single structure that substantially fills the chamber 112.

Figure 5B:
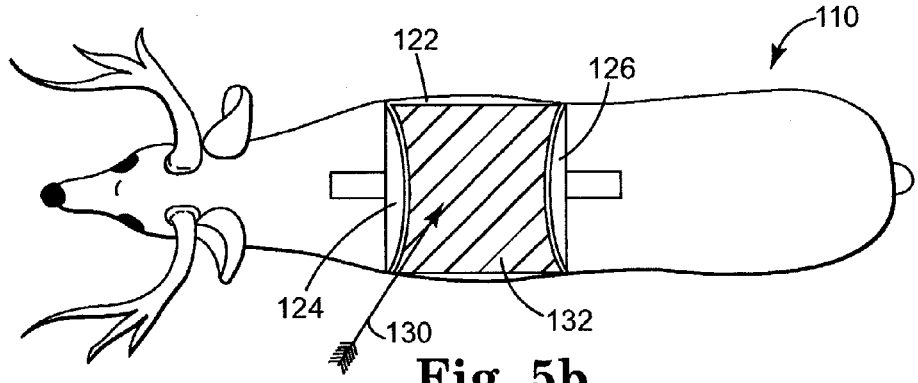

FIG. 5*b* is a top view of a three-dimensional archery target 120 with an alternate chamber 122 including curved structures 124, 126 adapted to mechanically couple with the target elements 132. The curved structures 124, 126 also serves to deflect arrows 130 towards the center of the chamber 122.

Figure 5C:
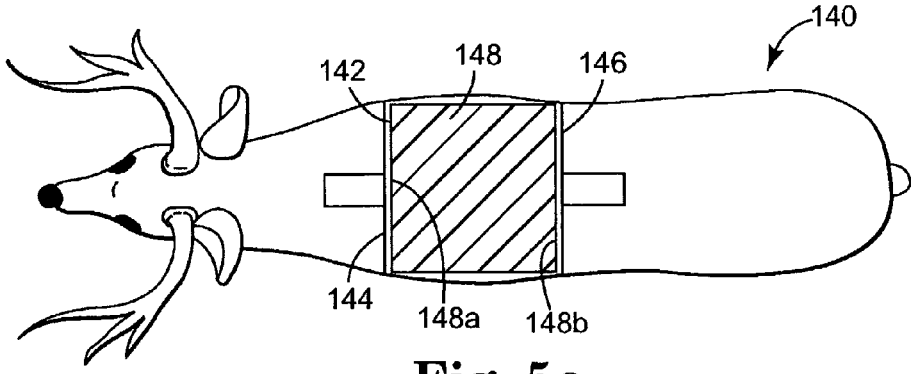

FIG. 5*c* is a top view of a three-dimensional archery target 140 having a chamber 142 with no structure for mechanically coupling with the target elements 148. Rather, the target elements 148 are retained in the chamber 142 by friction, such as along side edges 148*a*, 148*b* of the target element 148 and the side surfaces 144, 146 of the chamber 142. In another embodiment, frictional forces are applied to the target elements 148 by the lower surface of the cover and the lower surface of the chamber (see e.g., FIG. 3).

Figure 5D:
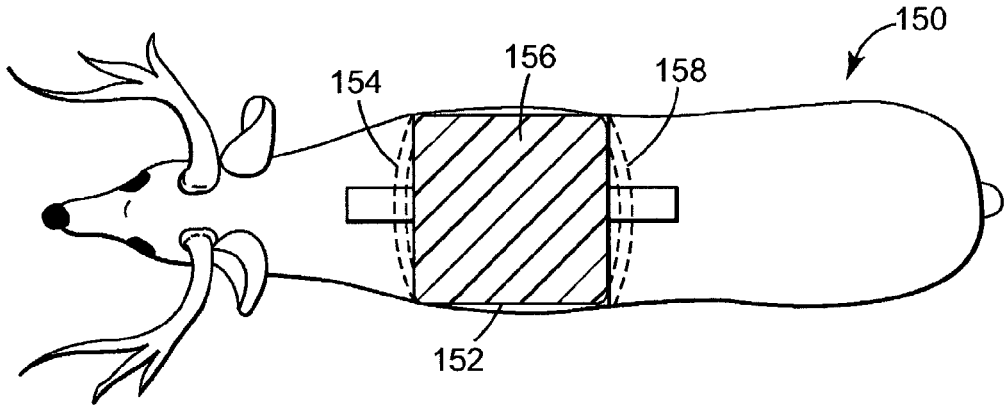

FIG. 5*d* is a top view of an archery target 150 in which the chamber 152 includes a pair of opposing concave recesses or undercuts 154, 158 adapted to mechanically couple with target elements 156. The undercuts 154, 158 extend into the body segment a sufficient amount to retain the target element 156 in the archery target 150. In an embodiment where the target element 148 is a single piece of material, the target element is preferably constructed from a resilient material, such as foam, that will return to substantially its original shape after being deformed to engaged with the undercuts 154, 158.

Figure 5E:
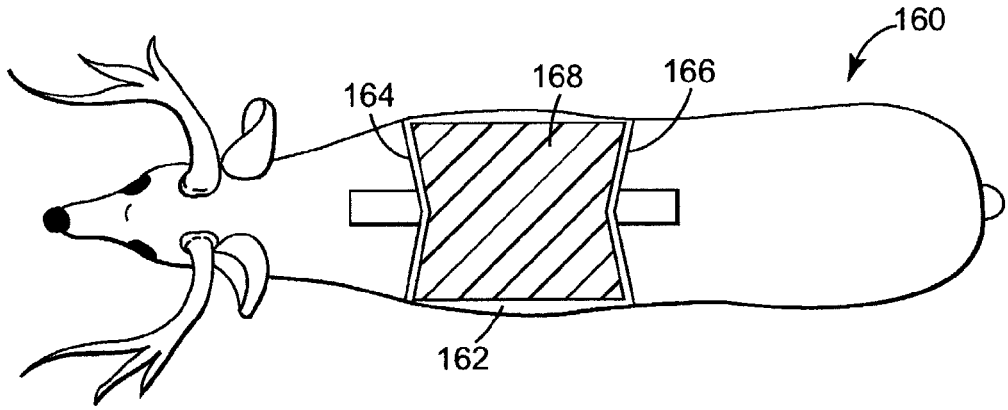

FIG. 5*e* is a top view of an archery target 160 having a chamber 162 with tapered sidewalls 164, 166. The tapered sidewalls serve to direct arrows towards the center of the chamber 162. The target elements 168 preferably have corresponding tapers to mechanically couple with the sidewalls 164, 166.

Figure 5F:
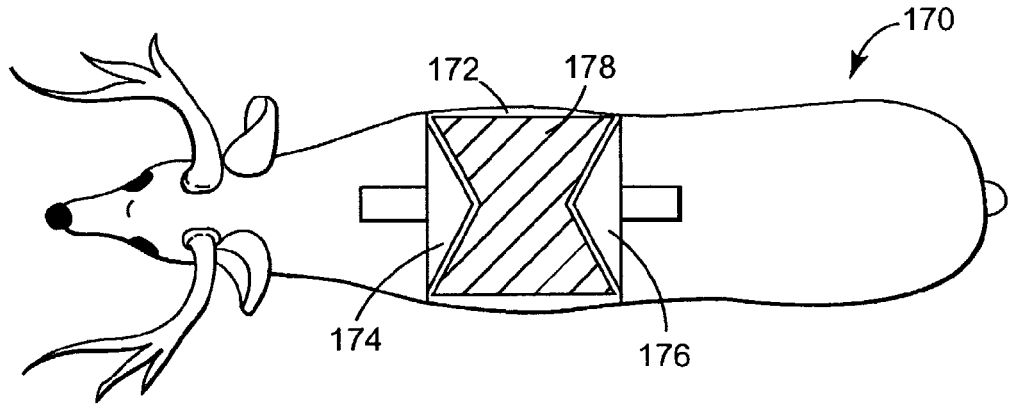

FIG. 5*f* is a top view of an archery target 170 having a chamber 172 with a pair of opposing tapered structures 174, 176. The tapered structures 174, 176 mechanically couple with corresponding tapers in the target elements to retain the target elements 178 in the chamber 172.

FIG. 6 is a side view of an alternate three-dimensional target 180 in which the chamber 182 is substantially surrounded by lower reinforcing member 184 and upper reinforcing member 186. The lower reinforcing member 184 is molded into the first body segment 22. The upper reinforcing member 186 is molded into the cover 42. In the illustrated embodiment, the pins 48, 50 preferably engage with the distal ends of the reinforcing members 184, 186.

Consequently, the replaceable target assembly 40 is completely surrounded by an interlinked reinforcing structure that provide a substantial compressive force on at least the major surfaces of the target elements 52.

Figure 7:
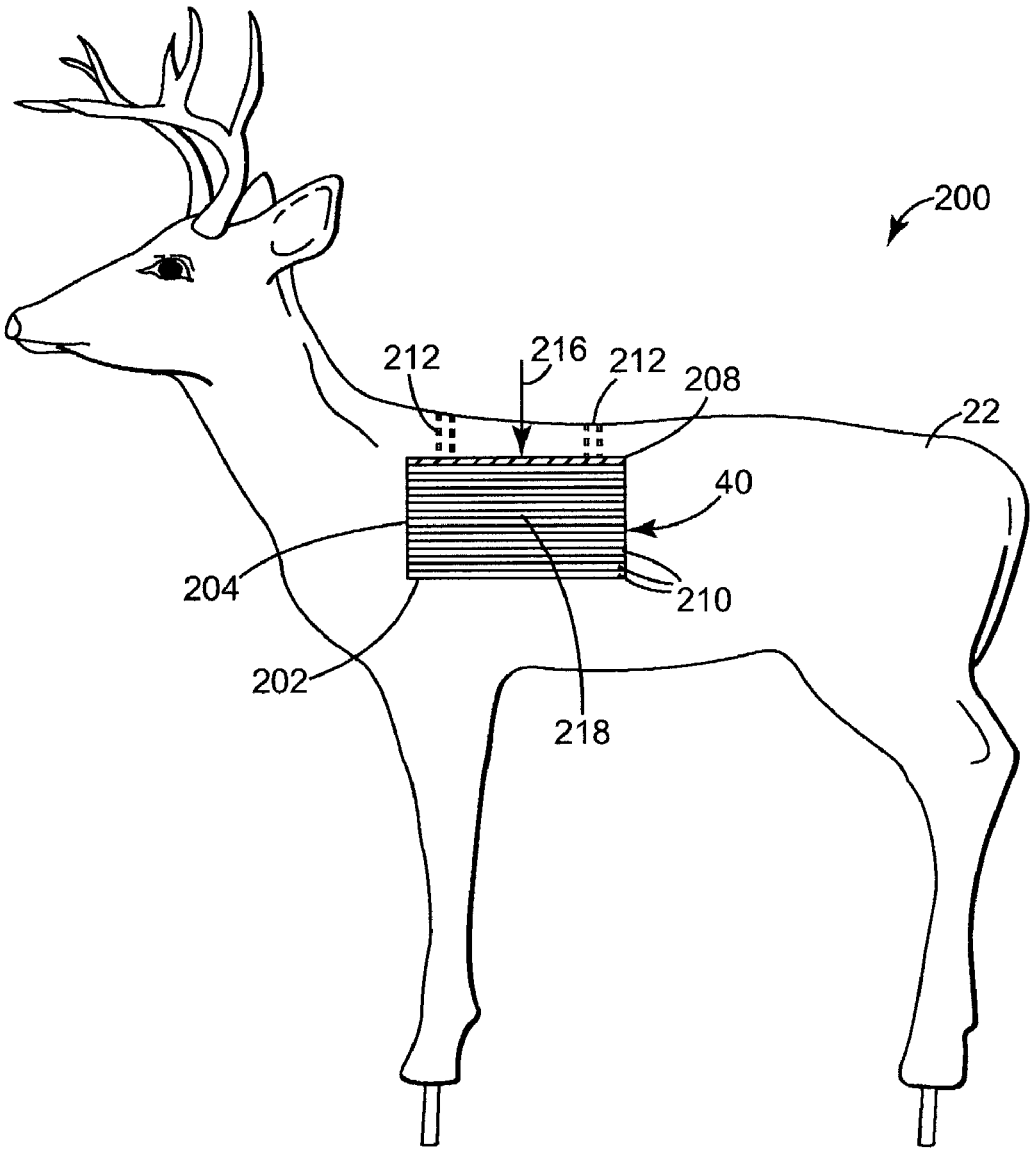
FIG. 7 illustrates a mechanism for compressing the target elements in an archery target in accordance with the present invention.
Figure 8:
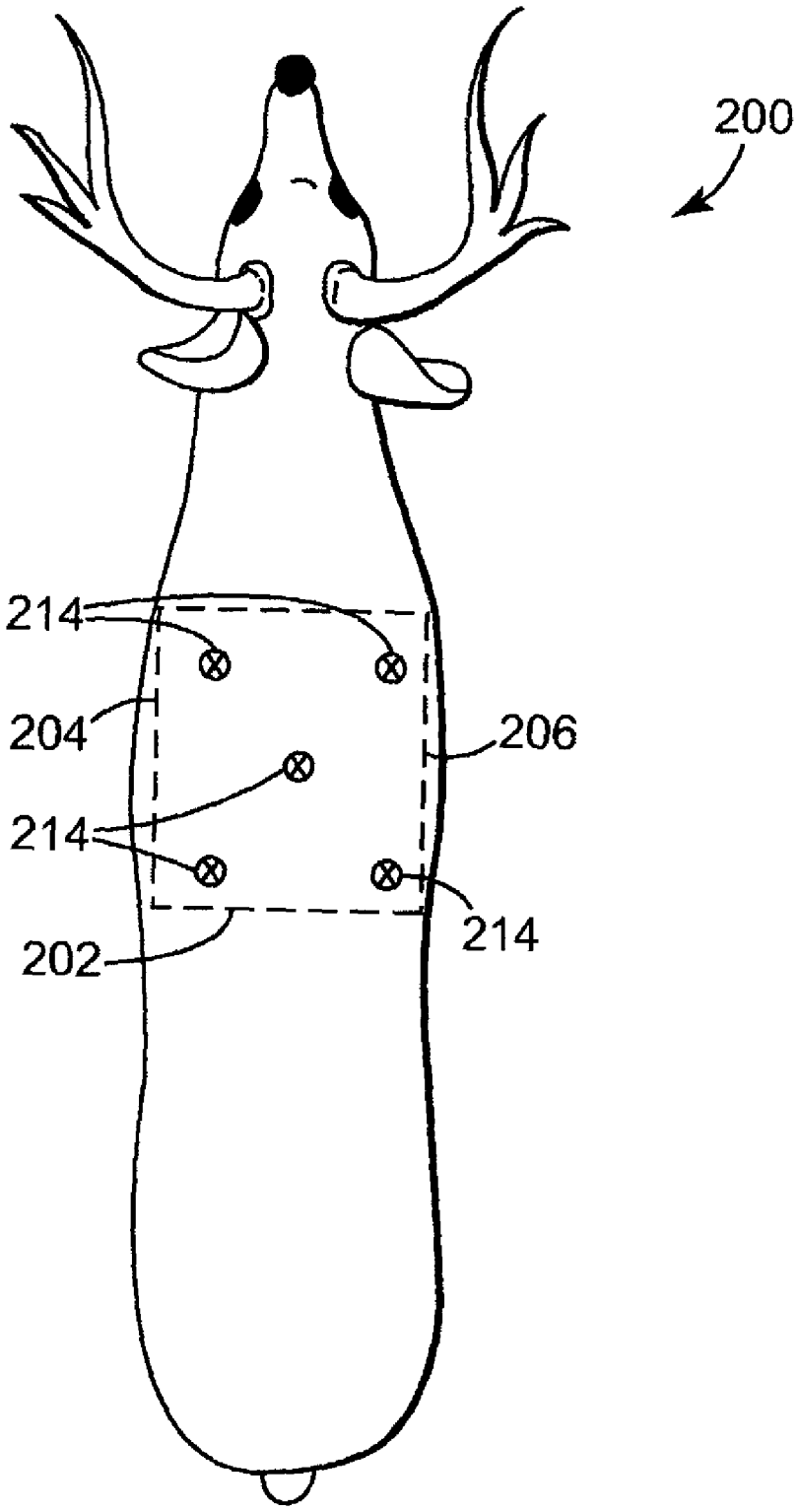
FIG. 8 is a top view of the archery target of FIG. 7.

FIGS. 7 and 8 illustrate an alternate three-dimensional target 200 in which chamber 202 for receiving the replaceable target assembly 40 is completely surrounded by the material forming the first body segment 22. In one embodiment, replaceable target assembly 40 is slid into the chamber 202 through one of the target apertures 204, 206.

In one embodiment, plate 208 is located on top of the stack of target elements 210. The plate can be any rigid or semi-rigid material capable of transmitting a compressive force to the target elements 210, such as wood, plastic, metal or composites thereof. Wood and plastic are preferred because an arrow tip striking a metal plate would likely be damaged.

In one embodiment, displacement mechanisms 212 are provided to displace the plate 208 into a compressive relationship with the target elements 210. The illustrated displacement mechanisms 212 are threaded members embedded in the first body segment 22. As best illustrated in FIG. 8, adjustment points 214 are located along the top of the archery target 200. The user can adjust the compressive force 216 applied to the major surface of the target elements 210 by turning one or more of the adjustment points 214. The compressive force 216 is opposed by the lower surface of the chamber 202. Providing a plurality of adjustment points permits the force 216 to vary in different locations along the target face 218.

In another embodiment, the displacement mechanisms 212 are an integral part of the plate 208. For example, the plate 208 could be two plates with a scissors mechanism or cam structure adapted to displace one plate relative to the other.

In another embodiment, the displacement mechanisms 212 are eliminated and the plate 208 is a wedge shaped member that is pushed into the chamber 202 through one of the target apertures 204, 206 after the target elements 210 are in place. The wedge shape of the plate 208 creates the compress force 216 on the target elements 210 located in the chamber 202. A pair of wedge shaped plates 208 simultaneously forced into both target apertures 204, 206 is preferred. The opposing forces applied to the opposing wedge shaped members serve to minimize movement or shifting of the target elements 210 in the chamber 202.

The wedge shaped plates 208 can be located on the top, the bottom, or anywhere in the stack of target elements 210. In one embodiment, the wedge shaped plate 208 is constructed from a high density foam that can be inserted anywhere in the stack of target elements 210. The compressive force 216 can be increased by increasing the number of wedge shaped plates 208 inserted into the stack of target elements 210 and/or by increasing the number of target elements 210 in the chamber 202.

Figure 13:
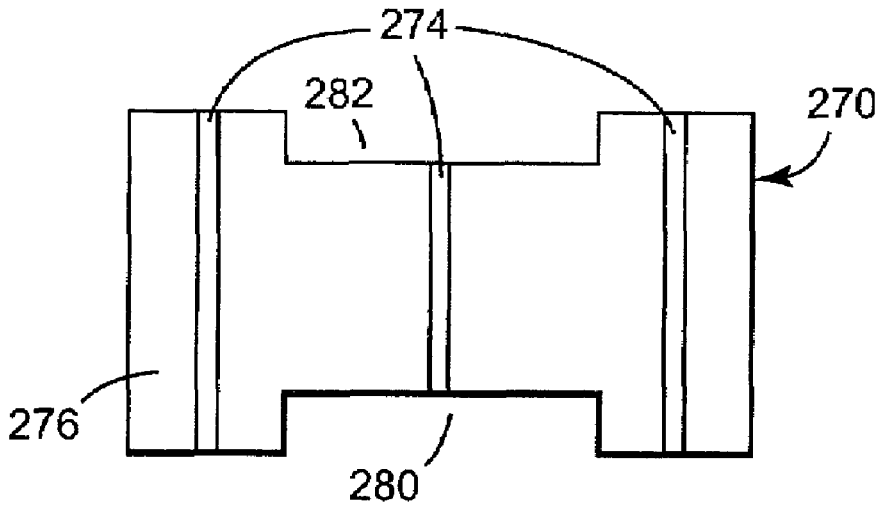
FIG. 13 is a top view of a replaceable target assembly in accordance with the present invention.
Figure 14:
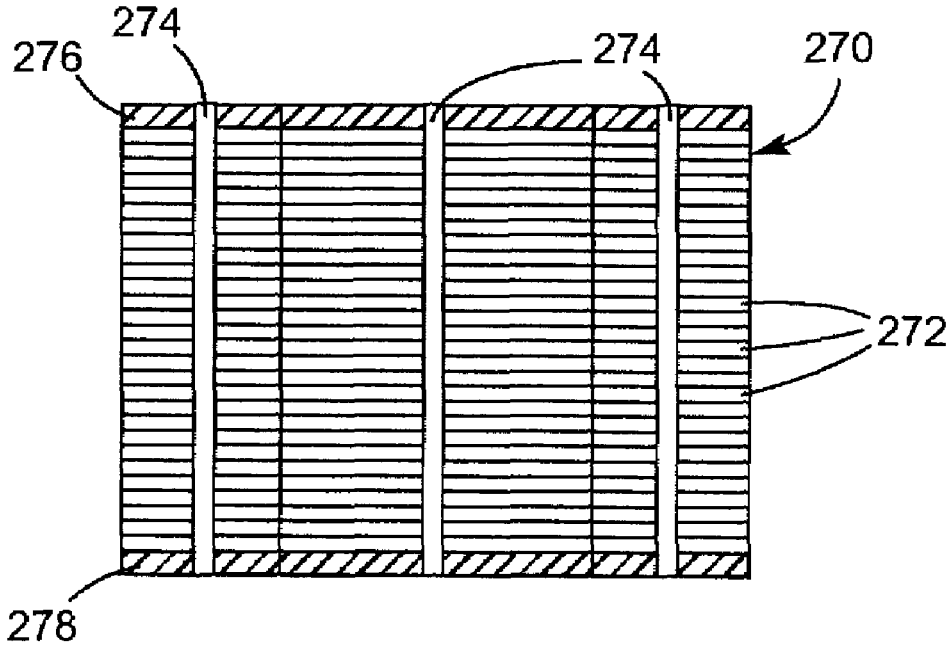
FIG. 14 is a side view of the replaceable target assembly of FIG. 13.

In yet another embodiment, a replaceable target assembly, such as the replaceable target assembly 270 in FIGS. 13 and 14, is slid into the chamber 202 through one of the target apertures 204, 206. The shape of the target elements 272 can vary from that disclosed in FIG. 13. The displacement mechanisms 212 are preferably treaded members that can be advanced to engage with the replaceable target assembly 270 to retain it in the chamber 202. Any of the embodiments of FIGS. 7 and 8 can be used with target elements oriented vertically or a variety of other angles.

Figure 9:
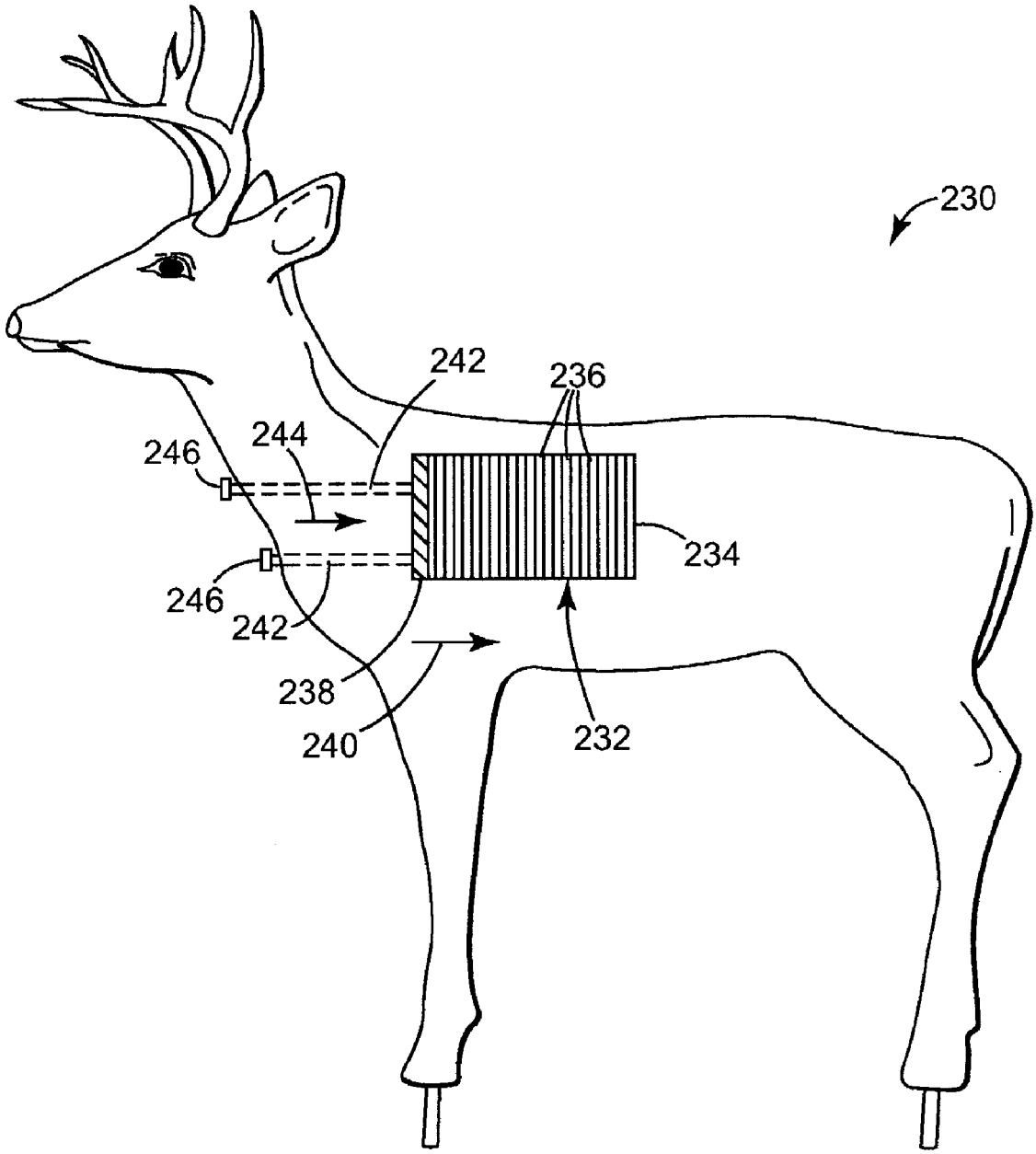
FIG. 9 illustrates an alternate mechanism for compressing the target elements in an archery target in accordance with the present invention.

FIG. 9 is a side view of an alternate three-dimensional archery target 230 in accordance with the present invention. The replaceable target assembly 232 is located in the chamber 234 with the target elements 236 oriented vertically. It is within the scope of the present invention to arrange the target elements 236 in any orientation. Plate 238 is displaced in a direction 240 by displacement mechanisms 242 so as to create compression force 244 on the major surface of the target elements 236. The compressive force 244 is opposed by the rear wall of the chamber 234. In the illustrated embodiment, the displacement mechanisms 242 include one or more knobs 246 located near the front of the archery target 230. The knobs 246 are easily turned to increase or decrease the compressive force 244 on the replaceable target assembly 232. The knobs 246 allow the user to reduce the compressive force 244 so that one or more of the target elements 236 can be replaced.

Figure 10:
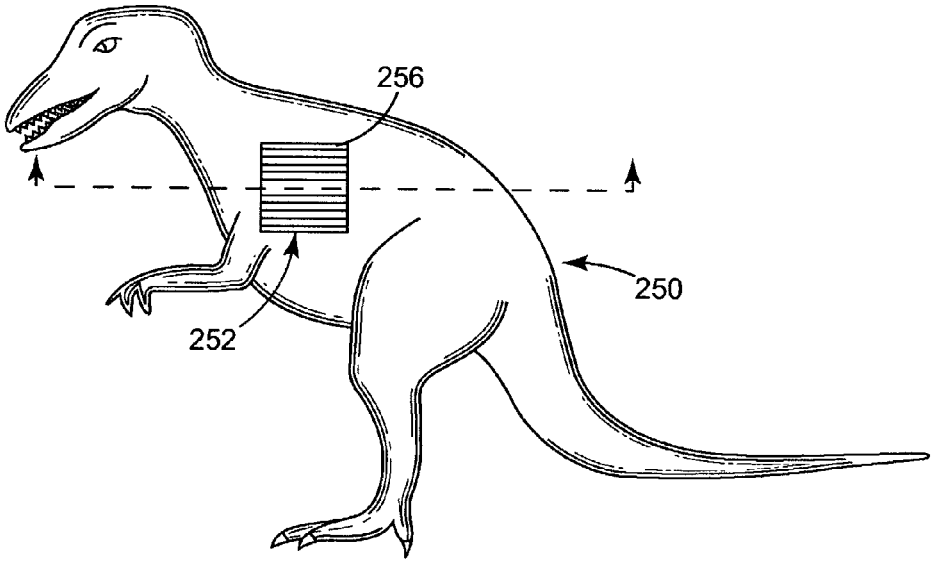
FIG. 10 is a side view of an alternate archery target in accordance with the present invention.
Figure 11:
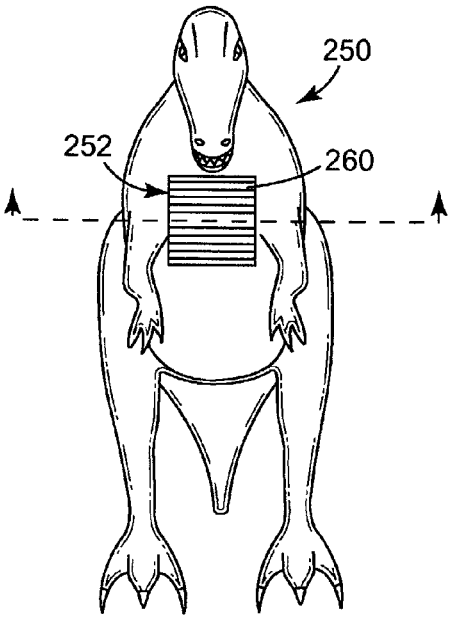
FIG. 11 is a front view of the archery target of FIG. 10.
Figure 12:
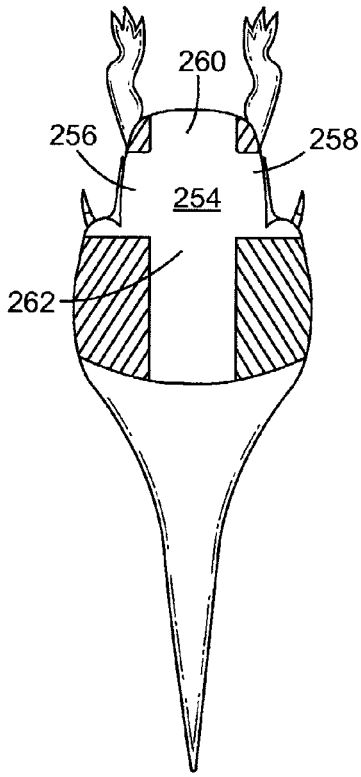
FIG. 12 is a sectional view of the archery target of FIGS. 10 and 11.

FIGS. 10 and 11 illustrate side and front views of an alternate three-dimensional archery target 250 in accordance with the present invention. As best illustrated in FIG. 12, the archery target 250 includes a single chamber 254 that is accessible through first and second target apertures 256, 258 along the sides of the archery target 250 and third and fourth target apertures 260, 262 located along the front and rear of the archery target 250. In the illustrated embodiment, a single replaceable target assembly 252 is preferably located in the chamber 254. Consequently, the user can launch arrows at all four sides of the archery target 250. Any of the target elements and displacement mechanisms disclosed herein can be used with the archery target 250.

FIGS. 13 and 14 illustrate an alternate replaceable target assembly 270 in accordance with the present invention. A plurality of target elements 272 is retained in a pre-compressed state by one or more bands 274. The bands can be metal, polymeric, natural fibers, or combinations thereof. Plates 276, 278 can optionally be located on the top and the bottom of the stack of target elements 272. The plates 276, 278 can be larger than, smaller than, or the same size and shape as the target elements 272. In the embodiment illustrated in FIGS. 13 and 14, the replaceable target assembly 270 includes a pair of opposing recesses 280, 282 which correspond to structures in the chamber of the three-dimensional archery target (see e.g., FIG. 4).

In another embodiment, the replaceable target assembly 270 is a continuous piece of homogeneous or composite material, such as foam, having the opposing recesses 280, 282, with or without the plates 276, 278. In yet another embodiment, the replaceable target assembly 270 is a plurality of pieces of material, such as foam, bonded together to form a single structure. Any of the target element shapes disclosed herein can be used in these various embodiments of the replaceable target assembly 270.

The replaceable target assembly 270 of FIGS. 13 and 14 are preferably pre-compressed so as to not require any additional compression by the three-dimensional archery target. Consequently, the replaceable target assembly 270 can be used with a wide variety of archery targets. On the other hand, an arrow strike can possibly cut the bands 274 and decompress the target elements 272, rendering the replaceable target assembly 270 inoperative. Additional, it is not possible to replace a single target element 272 without disassembling the entire replaceable target assembly 270. Rather, the whole replaceable target assembly 270 must be replaced. In an alternate embodiment, a pre-compressed version of the replaceable target assembly 270 is used in combination with compressive force provided by the three-dimensional archery target (see e.g., FIGS. 1, 7, 9).

All patents and patent applications disclosed herein, including those disclosed in the background of the invention, are hereby incorporated by reference. Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention. For example and although the target elements of uniformly thick layers is disclosed, differing thickness might also be incorporated into the target assembly.

What is claimed is:

1. A three-dimensional archery target comprising:

at least one three-dimensional body segment simulating an animal comprising an outer surface having at least one target aperture and a chamber, the body segment extending around a portion of a perimeter of the chamber, wherein the target aperture is connected to the chamber within the body segment;

a cover secured to the body segment and substantially completing the perimeter of the chamber, the cover acting as a tension and compression member in combination with the body segment to reinforce the three-dimensional archery target adjacent to the chamber;

one or more planar target elements located in the chamber, the planar target elements comprising a plurality of side edges forming a target face accessible through the target aperture;

one or more bands surrounding a plurality of the planar target elements located in the chamber; and a rigid or semi-rigid compression member distributing a compressive force generally across major surfaces of the planar target elements.

2. The archery target of claim 1 wherein the chamber applies at least a portion of the compressive force to the planar target elements.

3. The archery target of claim 1 wherein the cover applies at least a portion of the compressive force to the major surfaces of the planar target elements.

4. The archery target of claim 1 wherein the compression member comprises a surface on the cover.

5. The archery target of claim 1 wherein the cover is pivotally attached to the body segment.

6. The archery target of claim 1 wherein the compression member comprises a non-planar surface compressively engaged with the major surfaces of the planar target elements.

7. The archery target of claim 1 wherein the compression member is located in the chamber.

8. The archery target of claim 1 comprising one or more displacement mechanisms adapted to displace the compression member into compressive engagement with the planar target elements located in the chamber.

9. The archery target of claim 1 wherein the compression member comprises a wedge shape.

10. The archery target of claim 1 wherein the cover is integrally formed with the body segment.

11. The archery target of claim 1 wherein the target face is substantially unobstructed by the cover.

12. The archery target of claim 1 wherein the chamber comprises at least one surface adapted to mechanically couple with the planar target elements.

13. The archery target of claim 1 wherein the chamber comprises first and second opposing surfaces adapted to frictionally engaged with the planar target elements.

14. The archery target of claim 1 wherein the one or more planar target elements comprise a replaceable target assembly.

15. The archery target of claim 1 wherein the side edges of the planar target elements are arranged generally horizontally within the chamber.

16. The archery target of claim 1 wherein the side edges of the planar target elements are arranged generally vertically within the chamber.

17. The archery target of claim 1 wherein the planar target elements comprise a foam.

18. The archery target of claim 1 wherein the one or more planar target elements comprises a plurality of discrete planar target elements.

19. The archery target of claim 1 comprising a pair of target apertures located on opposite sides of the body segment, wherein each of the target apertures are connected to the chamber.

20. The archery target of claim 1 wherein the body segment comprises at least three target apertures each connected to the chamber.

21. The archery target of claim 1 wherein the body segment comprises two generally perpendicular target apertures each connected to the chamber.

22. The archery target of claim 1 wherein the target face is generally coplanar with a portion of the outer surface adjacent to the target aperture.

23. The archery target of claim 1 wherein the body segment comprises a plurality of interconnected body segments.

24. The archery target of claim 1 comprising reinforcing members extending through the cover.

25. The archery target of claim 1 comprising reinforcing members extending substantially around the chamber.

26. The archery target of claim 1 wherein the body segment comprises foam.

27. A three-dimensional archery target comprising:

at least one three-dimensional body segment simulating an animal comprising an outer surface having at least one target aperture, wherein the target aperture is connected to a chamber within the body segment, the body segment extending completely around a perimeter of the chamber to provide tension and compression reinforcement to the three-dimensional archery target adjacent to the chamber;

one or more planar target elements located in the chambers the planar target elements comprising a plurality of side edges forming a target face accessible through the target aperture, wherein a rigid or semi-rigid portion of the three-dimensional archery target distributes a compressive force generally across major surfaces of the planar target elements; and one or more bands surrounding a plurality of the planar target elements located in the chamber providing at least a portion of the compressive force.

28. The archery target of claim 27 wherein the planar target elements comprise a shape that mechanically couples with the chamber.

29. The archery target of claim 27 wherein the body segment comprises a cover that distributes at least a portion of the compressive force.

30. The archery target of claim 29 comprising a compression member located in the chamber providing at least a portion of the compressive force.

31. The archery target of claim 30 wherein at least one of the bands surrounds the compression member and the plurality of planar target elements.

32. The archery target of claim 27 wherein the one or more planar target elements comprise a replaceable target assembly.

33. A three-dimensional archery target comprising:

at least one three-dimensional body segment simulating an animal comprising an outer surface having at least one target aperture chamber, wherein the target aperture is connected to a chamber within the body segment, the body segment extending completely around a perimeter of the chamber to provide tension and compression reinforcement to the three-dimensional archery target adjacent to the chamber;

one or more planar target elements located in the chamber and subject to a compressive force on major surfaces thereof, the planar target elements comprising a plurality of side edges forming a target face accessible through the target aperture;

a rigid or semi-rigid compression member distributing the compressive force generally across the major surfaces of the planar target elements; and reinforcing members adapted to operate in tension and compression extending substantially around the perimeter of the chamber.

34. The archery target of claim 33 wherein a portion of the reinforcing members are located in a cover that extends along a portion of a perimeter of the chamber.

35. The archery target of claim 33 wherein the reinforcing members transmit at least a portion of the compressive force to the planar target elements.

36. The archery target of claim 33 comprising one or more bands surrounding a plurality of the planar target elements located in the chamber.

37. The archery target of claim 36 wherein at least one of the bands surrounds the compression member.

38. The archery target of claim 34 wherein the compression member comprises a surface on the cover.

39. A three-dimensional archery target comprising:

at least one three-dimensional body segment simulating an animal comprising an outer surface having at least one target aperture, wherein the target aperture is connected to a chamber within the body segment, the body segment extending completely around a perimeter of the chamber to provide tension and compression reinforcement to the three-dimensional archery target adjacent to the chamber;

one or more planar target elements located in the chamber, the planar target elements comprising a plurality of side edges forming a target face accessible through the target aperture; and a moveable rigid or semi-rigid displacement mechanism having a non-planar surface applying a compressive force generally across the major surfaces of the planar target elements.

40. A three-dimensional archery target comprising:

at least one three-dimensional body segment simulating an animal comprising an outer surface having at least one target aperture and a chamber, the body segment extending around a portion of a perimeter of the chamber, wherein the target aperture is connected to the chamber within the body segment;

a cover pivotally attached to the body segment and substantially completing the perimeter of the chamber, the cover acting as a tension and compression member in combination with the body segment to reinforce the three-dimensional archery target adjacent to the chamber;

one or more planar target elements located in the chamber, the planar target elements comprising a plurality of side edges forming a target face accessible through the target aperture, wherein the target face is substantially unobstructed by the cover; and a rigid or semi-rigid mechanism applying a compressive force generally across the major surfaces of the planar target elements.

41. A three-dimensional archery target comprising:

at least one three-dimensional body segment simulating an animal comprising an outer surface having at least one target aperture, wherein the target aperture is connected to a chamber within the body segment, the body segment extending completely around a perimeter of the chamber to provide tension and compression reinforcement to the three-dimensional archery target adjacent to the chamber; and one or more planar target elements located in the chamber, the planar target elements comprising a plurality of side edges forming a target face accessible through the target aperture, wherein a rigid or semi-rigid portion of the three-dimensional archery target comprising a non-planar surface applies a compressive force generally across major surfaces of the planar target elements.

42. The archery target of claim 41 wherein the body segment comprises a cover completing a portion of the perimeter of the chamber, the cover acting as a tension and compression member in combination with the body segment to reinforce the three-dimensional archery target adjacent to the chamber.

43. The archery target of claim 41 wherein at least a portion of the non-planarity of the rigid or semi-rigid portion arises from the compressive force.

44. A three-dimensional archery target comprising:

at least one three-dimensional body segment simulating an animal comprising an outer surface having at least one target aperture chamber, wherein the target aperture is connected to a chamber within the body segment, the body segment extending completely around a perimeter of the chamber to provide tension and compression reinforcement to the three-dimensional archery target adjacent to the chamber;

one or more planar target elements located in the chamber and subject to a compressive force on major surfaces thereof, the planar target elements comprising a plurality of side edges forming a target face accessible through the target aperture;

a rigid or semi-rigid compression member distributing the compressive force generally across the major surfaces of the planar target elements; and reinforcing members molded in the body segment simulating an animal adapted to operate in tension and compression extending along at least a portion of the perimeter of the chamber.

45. The archery target of claim 44 wherein a portion of the reinforcing members comprise a cover that extends along a portion of a perimeter of the chamber.

46. The archery target of claim 44 comprising one or more bands surrounding a plurality of the planar target elements located in the chamber.

47. A three-dimensional archery target comprising:

at least one three-dimensional body segment simulating an animal comprising an outer surface having at least one target aperture and a chamber, the body segment extending around a portion of a perimeter of the chamber, wherein the target aperture is connected to the chamber within the body segment;

a cover pivotally attached to the body segment and substantially completing the perimeter of the chamber, the cover acting as a tension and compression member in combination with the body segment to reinforce the three-dimensional archery target adjacent to the chamber;

one or more planar target elements located in the chamber, the planar target elements comprising a plurality of side edges forming a target face accessible through the target aperture; and a rigid or semi-rigid compression member distributing a compressive force generally across major surfaces of the planar target elements.

48. A three-dimensional archery target comprising:

at least one three-dimensional body segment simulating an animal comprising an outer surface having at least one target aperture and a chamber, the body segment extending around a portion of a perimeter of the chamber, wherein the target aperture is connected to the chamber within the body segment;

a cover secured to the body segment and substantially completing the perimeter of the chamber, the cover acting as a tension and compression member in combination with the body segment to reinforce the three-dimensional archery target adjacent to the chamber;

one or more planar target elements located in the chamber, the planar target elements comprising a plurality of side edges forming a target face accessible through the target aperture; and a rigid or semi-rigid compression member comprising a non-planar surface compressively engaged generally across major surfaces of the planar target elements.

* * * * *

UNITED STATES PATENT AND TRADEMARK OFFICE

CERTIFICATE OF CORRECTION

PATENT NO. : 6,983,939 B2
DATED : January 10, 2006
INVENTOR(S) : Larry R. Pulkrabek It is certified that error appears in the above-identified patent and that said Letters Patent is hereby corrected as shown below:

Column 12,
Lines 35-36, delete “chambers” and replace it with -- chamber --.

Signed and Sealed this

Eleventh Day of April, 2006

JON W. DUDAS
*Director of the United States Patent and Trademark Office*